US005914210A

United States Patent [19]

Demizu et al.

[11] Patent Number: 5,914,210

[45] Date of Patent: Jun. 22, 1999

[54] DEVELOPER AND DEVELOPING METHOD

[75] Inventors: Ichiro Demizu, Toyonaka; Yoshikazu Nishihara, Itami; Yoshihiro Mikuriya, Amagasaki; Takeshi Ishida, Nara, all of Japan

[73] Assignee: Minolta Co., Ltd., Osaka, Japan

[21] Appl. No.: 08/903,010

[22] Filed: Jul. 30, 1997

[30] Foreign Application Priority Data

Aug. 1, 1996 [JP] Japan ..... 8-220513
Aug. 6, 1996 [JP] Japan ..... 8-224427

[51] Int. Cl.[6] ..... G03G 9/097; G03G 9/083; G03G 13/09

[52] U.S. Cl. ..... 430/110; 111/122

[58] Field of Search ..... 430/110, 111, 430/122

[56] References Cited

U.S. PATENT DOCUMENTS

| | | | |
|---|---|---|---|
| 5,024,915 | 6/1991 | Sato et al. | 430/110 |
| 5,212,037 | 5/1993 | Julien et al. | 430/110 |
| 5,318,873 | 6/1994 | Kawamura et al. | 430/122 |
| 5,346,791 | 9/1994 | Ozawa et al. | 430/106.6 |
| 5,395,717 | 3/1995 | Ozawa et al. | 430/106.6 |
| 5,482,805 | 1/1996 | Grande et al. | 430/110 |
| 5,486,443 | 1/1996 | Grande et al. | 430/110 |
| 5,504,559 | 4/1996 | Ojima et al. | 430/126 |
| 5,637,432 | 6/1997 | Okado et al. | 430/111 |
| 5,693,444 | 12/1997 | Takagi et al. | 430/111 |
| 5,695,902 | 12/1997 | Mikuriya et al. | 430/111 |

FOREIGN PATENT DOCUMENTS

| | | |
|---|---|---|
| 61015154 | 1/1986 | Japan . |
| 61015155 | 1/1986 | Japan . |
| 61278861 | 12/1986 | Japan . |

*Primary Examiner*—Roland Martin

[57] ABSTRACT

In the present invention, in carrying out reversal development of an electrostatic latent image formed on a positively charged amorphous silicon type photoreceptor, a developer including positively charged toner particles containing binder resin and a colorant, first inorganic fine particles having a number-average particle diameter of 0.1 to 3 $\mu$m, and second inorganic fine particles subjected to surface treatment by a hydrophobic agent and having an average primary particle diameter of 0.005 to 0.02 $\mu$m is used.

32 Claims, 6 Drawing Sheets

DEVELOPER AND DEVELOPING METHOD

BACKGROUND OF THE INVENTION

1. Field of the Invention

The present invention relates generally to a developer used for developing an electrostatic latent image formed on a photoreceptor and a developing method using the developer in an image forming apparatus such as a copying machine or a printer, and more particularly, to a developer used for carrying out reversal development of an electrostatic latent image formed on a positively charged amorphous silicon type photoreceptor and a developing method using the developer.

2. Description of the Related Art

Conventionally, an image forming apparatus such as a copying machine or a printer has been so adapted as to form an electrostatic latent image on the surface of a photoreceptor, supply a developer to the photoreceptor from a developing device, develop the electrostatic latent image formed on the photoreceptor to form a toner image on the photoreceptor, transfer the toner image on a recording medium such as paper, then press a cleaning blade or the like against the surface of the photoreceptor, and remove toner particles or the like remaining on the surface of the photoreceptor.

As the above-mentioned photoreceptor various materials have been conventionally used for composing its photosensitive layer. Examples are an organic photoreceptor using an organic material, a selenium type photoreceptor using a selenium type material, and an amorphous silicon type photoreceptor using an amorphous silicon type material.

When an image is formed in the above-mentioned manner using such a photoreceptor, a filler such as talc or calcium carbonate produced from a recording medium such as paper, or a toner component may, in some cases, be film-formed upon adhering to the surface of the photoreceptor.

When the above-mentioned photoreceptor is an organic photoreceptor using an organic material as a material composing its photosensitive layer or a selenium type photoreceptor using a selenium type material as a material composing its photosensitive layer, the photosensitive layer is relatively soft. When the cleaning blade or the like is pressed against the surface of the photoreceptor after the transfer as described above to remove the toner particles or the like remaining on the surface of the photoreceptor, the surface of the photoreceptor on which the filler, the toner component or the like adheres is shaved by the cleaning blade or the like. Therefore, few problems particularly arise.

In the case of the amorphous silicon type photoreceptor using the amorphous silicon type material as the photosensitive layer, however, the photosensitive layer on its surface is harder than those of the organic photoreceptor and the selenium type photoreceptor. When the toner particles or the like remaining on the surface of the photoreceptor are removed by the cleaning blade or the like as described above, therefore, the surface of the photoreceptor is not shaved by the cleaning blade or the like, and the filler, the toner component or the like adhering to the surface of the photoreceptor remains, to be film-formed. Therefore, the image quality of a formed image is gradually degraded.

Also in the prior art, therefore, a method of carrying out development using a developer having magnetic resin carrier particles having magnetic fine particles dispersed in binder resin, magnetic powder carrier particles, and abrasive magnetic toner particles having abrasive material fine particles fixed to their surfaces, to grind the surface of an amorphous silicon type photoreceptor, as disclosed in Japanese Patent Laid-Open No. 323674/1993, and a method of externally attaching predetermined silicon carbide to the surfaces of toner particles or adding the silicon carbide to a developer, and carrying out development using the developer to grind the surface of an amorphous silicon type photoreceptor, to prevent the above-mentioned film-formation, as disclosed in Japanese Patent Publication No. 29982/1994 and Japanese Patent Publication No. 29983/1994.

Also in the methods disclosed in the gazettes, however, it is still impossible to sufficiently prevent a filler, a toner component or the like adhering to the surface of the amorphous silicon type photoreceptor from being film-formed. When the above-mentioned developer is used, the toner particles are not sufficiently charged, whereby the toner particles are scattered, a formed image is fogged, and the fluidity of the developer is decreased so that the developer is offset in a developing device, and the density of the formed image is made non-uniform

SUMMARY OF THE INVENTION

An object of the present invention is to provide a developer suitable for use in carrying out reversal development of an electrostatic latent image formed on a positively charged amorphous silicon type photoreceptor Another object of the present invention is to prevent, in carrying out reversal development of an electrostatic latent image formed on a positively charged amorphous silicon type photoreceptor, a filler such as talc or a calcium carbonate, or a toner component from being film-formed upon adhering to the surface of the amorphous silicon type photoreceptor.

Still another object of the present invention is to make it possible for toner particles in a developer to be suitably charged, to stably obtain a good image for a long time without the possibilities that the toner particles are scattered, a formed image is fogged, for example, and the fluidity of the developer is decreased so that the density of the formed image is made non-uniform, for example, as in the prior art.

In the present invention, in carrying out reversal development of an electrostatic latent image formed on a positively charged amorphous silicon type photoreceptor, a developer including positively charged toner particles containing binder resin and a colorant first inorganic fine particles having a number-average particle diameter of 0.1 to 3 $\mu$m, and second inorganic fine particles subjected to surface treatment by a hydrophobic agent and having an average primary particle diameter of 0.005 to 0.02 $\mu$m.

When the first inorganic fine particles having a number-average particle diameter in the range of 0.1 to 3 $\mu$m and the second inorganic fine particles subjected to hydrophobic treatment and having an average primary particle diameter in the range of 0.005 to 0.02 $\mu$m are included in addition to the positively charged toner particles as in the developer, the surface of the amorphous silicon type photoreceptor is ground by the first inorganic fine particles, so that a filler such as talc or calcium carbonate, a toner component or the like is prevented from being film-formed on the surface of the amorphous silicon type photoreceptor. Further, the fluidity of the developer is improved by the second inorganic fine particles, and the positively charged toner particles are suitably charged, so that the toner particles are prevented from being scattered, and the formed image is prevented from being fogged and made nonuniform in density, for examples.

A developing method according to the present invention comprises the steps of supplying a developer including positively charged particles containing binder resin and a colorant, first inorganic fine particles having a number-average particle diameter of 0.1 to 3 μm, second inorganic fine particles subjected to surface treatment by a hydrophobic agent and having an average primary particle diameter of 0.005 to 0.02 μm, and carrier particles having a volume-average particle diameter of 40 to 80 μm, having a dynamic current value of 40 to 120 nA, and constructed by dispersing magnetic powder in binder resin onto a non-magnetic sleeve having a magnet member arranged in its inner part and driven to rotate, conveying the developer to a developing region which is a portion where the non-magnetic sleeve and a positively charged amorphous silicon type photoreceptor are opposite to each other by the rotation of the non-magnetic sleeve, and carrying out reversal development of an electrostatic latent image formed on the amorphous silicon type photoreceptor by the toner particles upon exerting a direct current electric field in the developing region.

When the carrier particles having a volume-average particle diameter in the range of 40 to 80 μm and having a dynamic current value in the range of 40 to 120 nA upon dispersing the magnetic powder in the binder resin are used in addition to the positively charged toner particles, the first inorganic fine particles and the second inorganic fine particles as in the developing method, the carrier particles are sufficiently prevented from adhering to the photoreceptor in carrying out the reversal development upon exerting the DC electric field on the developing region as described above, so that the toner particles can be sufficiently supplied to the photoreceptor.

Another developing method in the present invention comprises the steps of supplying a developer including positively charged toner particles containing binder resin and a colorant, first inorganic fine particles having a number-average particle diameter of 0.1 to 3 μm, second inorganic fine particles subjected to surface treatment by a hydrophobic agent and having an average primary particle diameter of 0.005 to 0.02 μm, and carrier particles having a volume-average particle diameter of 15 to 40 μm, having a dynamic current value of 5 to 40 nA, and constructed by dispersing magnetic powder in binder resin onto a non-magnetic sleeve having a magnet member arranged in its inner part and driven to rotate, conveying the developer to a developing region which is a portion where the non-magnetic sleeve and a positively charged amorphous silicon type photoreceptor are opposite to each other by the rotation of the non-magnetic sleeve, and carrying out reversal development of an electrostatic latent image formed on the amorphous silicon type photoreceptor by the toner particles upon exerting a vibrating electric field in the developing region.

In a case where the reversal development is carried out upon exerting the vibrating electric field on the developing region as in the developing method, even when the carrier particles having a small volume-average particle diameter in the range of 15 to 40 μm and having a low dynamic current value in the range of 5 to 40 nA upon dispersing the magnetic powder in the binder reign are used in addition to the positively charged toner particles, the first inorganic fine particles and the second inorganic fine particles, the carrier particles are prevented from adhering to the photoreceptor, and the toner particles are sufficiently supplied to the photoreceptor. As a result, no voids or the like are created in a formed image, so that a highly precise image is obtained.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
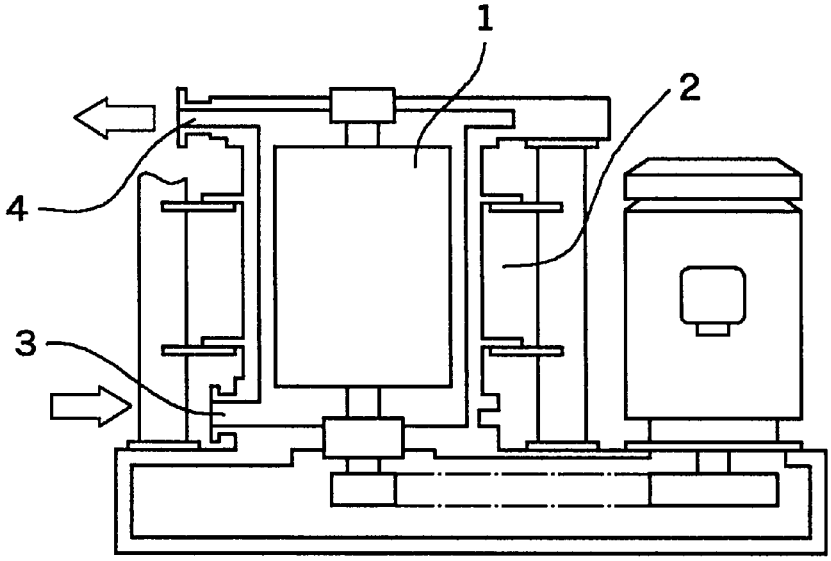
FIG. 1 is a schematic explanatory view of a mechanical pulverizer used for producing toner particles in an embodiment of the present invention.

Preferred embodiments of the present invention will be specifically described.

Examples of positively charged toner particles used for the above-mentioned developer in the present invention include one containing binder resin and a colorant as described above and containing an additive such as an offset preventing agent or a charge-controlling agent as required.

If the volume-average particle diameter of the toner particles is too larger a highly precise image is not obtained. On the other hands if the volume-average particle diameter thereof is too small, when the toner particles are produced by a pulverizing method, the content of fine powder is increased, resulting in degraded productivity. Therefore, it is preferable to use toner particles having volume-average particle diameter in the range of 6 to 12 μm.

When there is a large difference between the volume-average particle diameter and the number-average particle diameter of the toner particles, toner particles having various particle diameters exist, so that the toner particles are easily film-formed on an amorphous silicon type photoreceptor, and a formed image is easily fogged. Therefore, the value of (the volume-average particle diameter)/(the number-average particle diameter) is set in the range of 1.0 to 1.5, and preferably in the range of 1.0 to 1.35. It is preferable that the content of the toner particles having a volume-average particle diameter which is not more than one-half that of all the toner particles is not more than 20% by number.

Examples of the toner particles include ones having a shape factor as described below of 130 to 160, and preferably 130 to 150. Consider a case where the shape factor is lower than 130 so that the shape of the toner particles approaches a spherical shape. In this case, when the toner particles remaining on the surface of the photoreceptor are removed by a cleaning blade as described above, the toner particles are not satisfactorily removed, whereby the toner particles are liable to be insufficiently cleaned. On the contrary, when the shape factor is higher than 160 so that the shape of the toner particles is changed into an irregular shape, the fluidity of the toner particles is degraded, and the fine powder cannot be sufficiently removed, whereby the toner particles are easily film-formed.

The above-mentioned shape factor is a value found by the following equation (1), letting S be the average value of the projected areas of toner particles, and L be the average value of the maximum lengths of projected images of the toner particles, and represents the speroidicity of the particles. The shape of the toner particles approaches a spherical shape as the value of the shape factor is close to 100.

$$\text{Shape factor}=(L/S)\times(\pi/4)\times 100 \quad (1)$$

As the binder resin used for the above-mentioned toner particles, styrene type copolymer resin, polyester type resin, epoxy type resin, and the like can be arbitrarily used. In order to attain the object of the present invention more effectively, it is preferable to use the styrene type copolymer resin.

In thus using the styrene type copolymer resin as the binder resin in the toner particles, examples of styrene monomers include styrene,α-methyl styrene, p-methyl styrene, p-tert-butyl styrene, p-chlorostyrene and their derivatives. Examples of monomers copolymerized with the styrene monomers include, in addition to monomers such as acrylic acid and methacrylic acid, alkyl ester methacrylates such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl) butyl methacrylate, hexyl methacrylate, octyl methacrylate, nonyl methacrylate, decyl methacrylate, undecyl methacrylate, dodecyl methacrylate and the like, alkyl ester acrylates such as methyl acrylate, n-propyl acrylate, isopropyl acrylate, n-butyl acrylate, isobutyl acrylate, t-butyl acrylate, n-pentyl acrylate, isopentyl acrylate, neopentyl acrylates, 3-(methyl)butyl acrylate, hexyl acrylate, ocryl acrylate, nonyl acrylate, decyl acrylate, undecyl acrylate, dodecyl acrylate and the like, and vinyl monomers such as acrylonitrile, maleic acid, maleate, itaconate, vinyl chloride, vinyl acetate, vinyl benzoate, vinyl methyl ethyl ketone, vinyl hexyl ketone, vinyl methyl ether, vinyl ethyl ether, vinyl isobutyl ether and the like. Alkyl ester methacrylates (the number of carbons in an alkyl group is 1 to 17) and alkyl ester acrylates (the number of carbons in an alkyl group is 1 to 17) are preferably used.

If the number-average molecular weight Mn of the binder resin used in the toner particles is too low, the heat resistance of the toner particles is decreased, and the toner particles are easily offset. On the other hand, if the number-average molecular weight Mn thereof is too high, the fixing strength of the toner particles is decreased. Therefore, binder resin having a number-average molecular weight Mn of 2000 to 7000, and preferably 2500 to 6500 is used. If the ratio (Mw/Mn) of the weight-average molecular weight Mw to the number-average molecular weight Mn in the binder resin is low, the obtained toner particles are easily offset. On the other hand, if the ratio (Mw/Mn) is high, the fixing strength of the toner particles is decreased. Therefore, binder resin with a ratio (Mw/Mn) of 30 to 90, and preferably 40 to 80 is used.

Furthermore, in order to restrain the offset of the toner particles as well as to improve the fixing properties of the toner particles, it is preferable to use, as the binder resin, low molecular weight resin having a peak in the range of 2000 to 20000, and high molecular weight resin having a peak in the range of 50000 to 1000000, the peaks in a molecular weight distribution by weight measured by gel permeation chromatography, and more preferably low molecular weight resin having the peak in the range of 2500 to 10000 and high molecular weight resin having the peak in the range of 150000 to 800000.

In producing the above-mentioned toner particles, a binder resin, a colorant and a necessary additive are mixed with each other, a mixture obtained is heated and kneaded, and the kneaded mixture is cooled, after which the kneaded mixture is pulverized and classified, to produce toner particles.

In the steps of pulverizing and classifying the kneaded mixture as described above, it is desirable that the kneaded mixture is pulverized using a pulverizer for applying a mechanical impact force, and particles obtained by such pulverization are classified using a classifier for applying a mechanical impact force. When toner particles are thus produced, the shape factor of the toner particles is in the above-mentioned range.

In applying the mechanical impact force, a pulverizer and a classifier comprising a rotor rotating at high speed are used, and the toner particles are brought into contact with the rotor, to apply a physical impact force to the toner particles.

When the toner particles are obtained using the pulverizer and the classifier, ultrafine powder of liberated wax or the like is prevented from being produced, the chargeability of the toner particles is stabilized, and the flowability of the toner particles is improved. The toner particles are also prevented from being film-formed on the amorphous silicon type photoreceptor.

As the mechanical pulverizer for applying a mechanical impact force, a pulverizer as shown in FIG. 1, for example, can be used.

In the pulverizer, an outer peripheral surface of a cylindrical rotor 1 rotatably provided is provided with a lot of grooves along its axial direction, while an inner peripheral surface of a liner 2 provided on the outer periphery of the rotor 1 is also provided with a lot of grooves along its axial direction, as shown in FIG. 11. The rotor 1 is rotated at high speed, so that a violent eddy current and pressure vibration are produced in the pulverizer. Therefore, a raw material to be pulverized, along with air, is sucked from a suction port 3 and is supplied to the pulverizer.

Particles having a large particle diameter are volume-pulverized by an impact force produced by the rotor 1 and the liner 2 and the violent eddy current of air produced in a clearance therebetween, while particles having a small particle diameter are surface-pulverized. Ultrafine powder of liberated wax or the like is caused to adhere to the surfaces of particles obtained by the surface pulverization, and the particles, together with the air, are discharged from an exhaust hole 4. The surface pulverization means that the surfaces of the particles are shaved by a peeling function and at the same time, the ultrafine powder is caused to adhere to the surfaces of the particles, that is, rearrangement on the surfaces of the particles.

Figure 2:
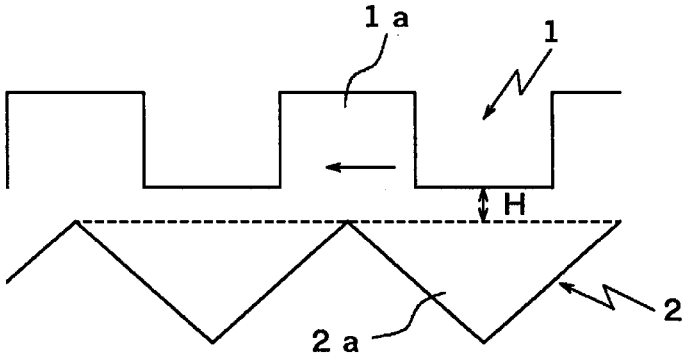
FIG. 2 is a partial explanatory view showing the states of a rotor and a liner in the mechanical pulverizer shown in FIG. 1.
Figure 2:
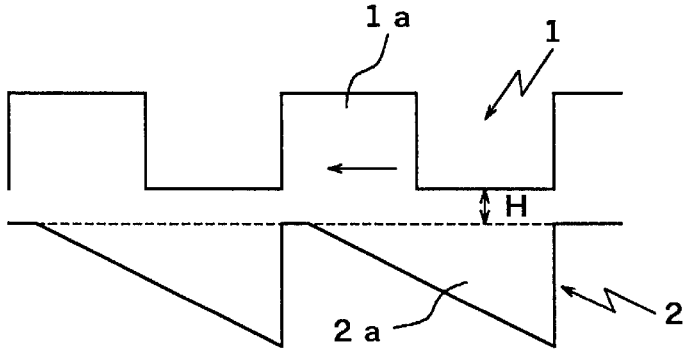
Figure 2:
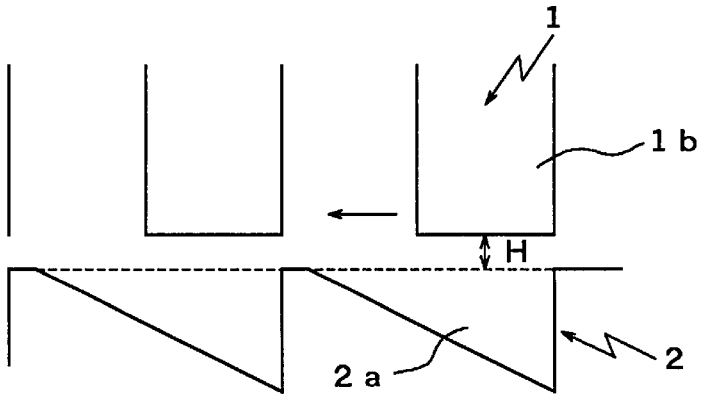

Although the shape of the grooves 2*a* formed on the inner peripheral surface of the liner 2 is not particularly limited, examples of the shape include the shape of an isosceles triangle as shown in FIG. 2(A) and the shape of a right angled triangle as shown in FIGS. 2(B) and 2(C). On the other hand, although the shape of a groove 1*a* formed on the outer peripheral surface of the rotor 1 is not particularly limited, examples of the shape include a square shape as shown in FIGS. 2(A) and 2(B). The groove 1*a* may be replaced with a blade 1*b*, as shown in FIG. 2(C). Further, the spacing H between the liner 2 and the rotor 1 in closest proximity is 0.2 to 10 mm, and preferably 0.3 to 5 mm.

In the case of the pulverization using the abovementioned mechanical pulverizer, the particles may be pulverized again by classifying the coarse particles out of the pulverized particles and returning the classified coarse particles to the mechanical pulverizer after the particles are pulverized as described above.

Examples of the mechanical pulverizer include Cryptron (manufactured by Kawasaki Heavy Industries, Ltd.), Turbo Mill (Turbo Mill Kogyo K.K.) and Fine Mill (Nippon Pneumatic Kogyo K.K.).

Examples of the classifier for classifying the coarse particles out of the particles pulverized by the mechanical pulverizer as described above include a coarse powder classifier (MS-O; manufactured by Hosokawa Mikuron K.K., DS-X Classifier; manufactured by Nippon Pneumatic K.K., Elbow Jet; manufactured by Nittetu Kogyo K.K., etc.).

In classifying the particles remaining after thus classifying the coarse particles it is preferable to use a classifier capable of applying a mechanical impact force as described above rather than an air classifier for classifying the particles depending on the weights of the particles. An example is a rotor type classifier having a classifying rotor.

When the particles are classified by such a classifier, the surfaces of the particles are smoothed or are made spherical by the function of an impact force produced by the classifying rotors and ultrafine powder of liberated wax or the like is strongly pressed against the surfaces of the toner particles and is embedded therein, so that the liberated ultrafine powder is decreased, and the dispersion efficiency of the particles is also improved, whereby the ultrafine powder is prevented from being included into a toner product.

Examples of the rotor type classifier include Turbo-Classifier (manufactured by Nisshin Engineering K.K.), and Acucut, for example, Donaselec Classifier (manufactured by Nippon Donaldson K.K.). Particularly, Teeplex Ultrafine Powder Classifier ATP Series (manufactured by Hosokawa Mikuron K.K.) is preferably used.

Figure 3:
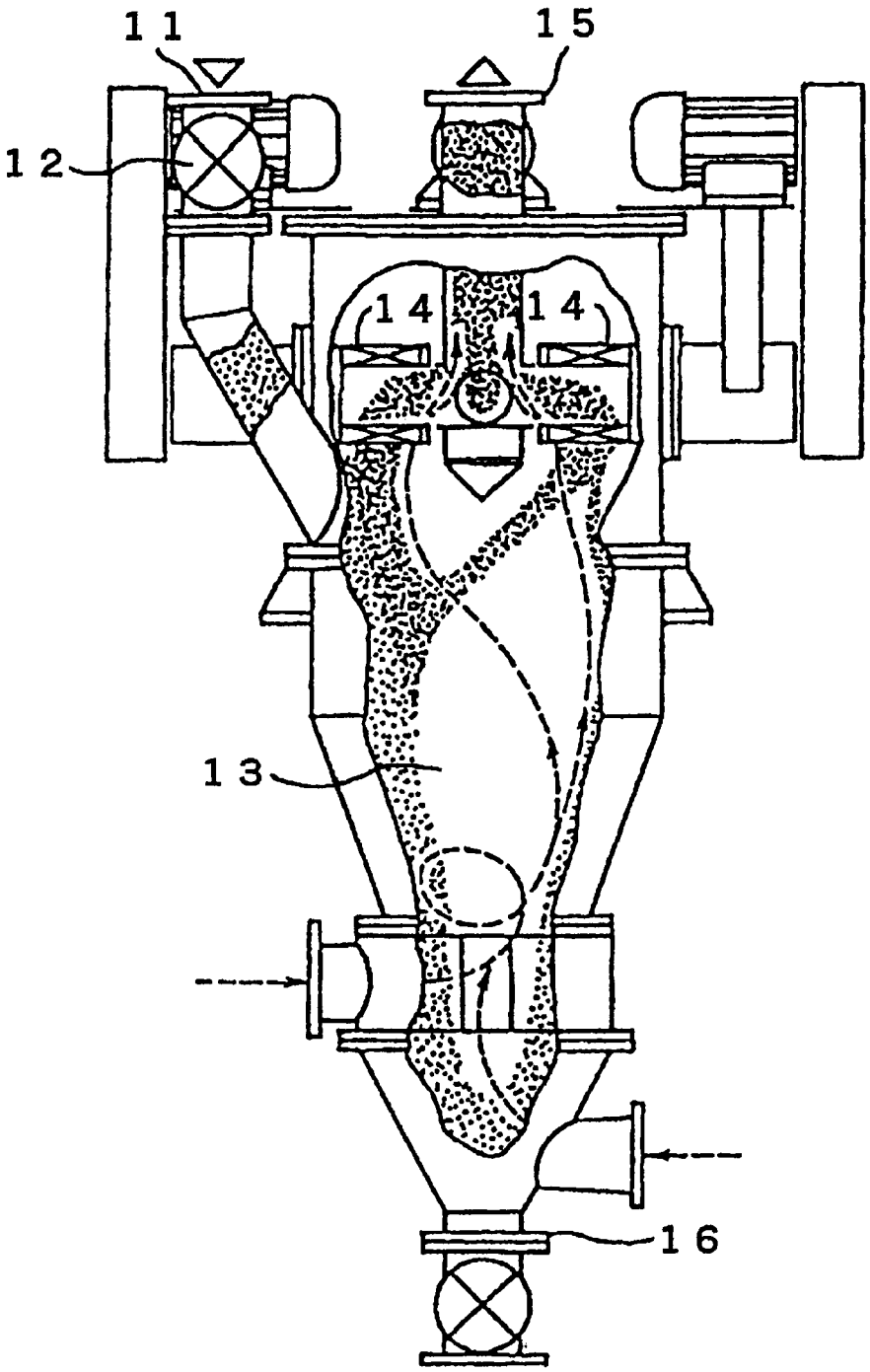
FIG. 3 is a schematic explanatory view of a Teeplex Multiwheel type classifier used in producing toner particles in the embodiment of the present invention.

A Teeplex Multiwheel type classifier in the abovementioned Teeplex Ultrafine Powder Classifier ATP Series is constructed as shown in FIG. 3.

Figure 4:
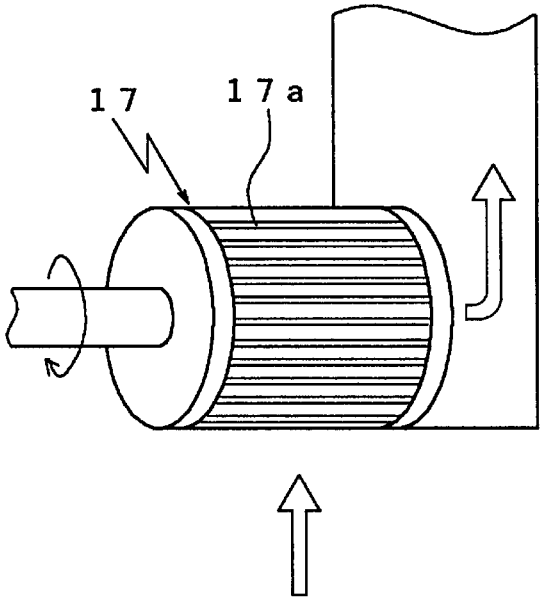
FIG. 4 is a schematic perspective view of a classifying rotor used in the Teeplex Multiwheel type classifier shown in FIG. 3.

The classifier is so adapted as to feed pulverized particles from a raw material inlet port 11, and introduce the particles into a classifying chamber 13 through a rotary valve 12 or the like, as shown in FIG. 3. Air flows upward from below as indicated by an arrow in the classifying chamber 13, the particles put in as described above are raised in accordance with the flow and are introduced into a classifying portion 14. The particles are classified in the classifying portion 14, and fine powder is taken out from a common fine powder discharge port 15, while the toner particles from which the fine powder is removed are taken out from a discharge port 16. The classifying portion 14 is horizontally provided with a plurality of cylindrical classifying rotors 17 having a lot of blades 17*a*, as shown in FIG. 4. The speed of each of the classifying rotors 17 is controlled by one frequency converter (not shown) using a separate driving system.

Fine particles having a number-average particle diameter in the range of 0.1 to 3 μm is used as first inorganic fine particles used for the developer in order to enhance a grinding effect on the amorphous silicon type photoreceptor The reason for this is that if first inorganic fine particles having an average particle diameter of 0.1 μm or less and first inorganic fine particles having an average particle diameter of 3 μm or more are used, the amorphous silicon type photoreceptor cannot be sufficiently ground, whereby it is impossible to sufficiently prevent a toner component or the like from being film-formed on the surface of the amorphous silicon type photoreceptor.

It is preferable to use, as the first inorganic fine particles, an aggregate of silica fine particles having a number-average particle diameter in the range of 0.1 to 3 μm obtained by aggregating silica fine particles having an average primary particle diameter in the range of 0.03 to 0.05 μm which are obtained by a gas phase method, silica fine particles having a number-average particle diameter in the range of 0.1 to 3 μm which are obtained by a wet method, metal zirconate fine particles having a number-average particle diameter in the range of 0.5 to 3 μm, titanium dioxide fine particles having a number-average particle diameter in the range of 0.5 to 3 μm, ferrite fine particles having a number-average particle diameter in the range of 0.1 to 3 μm, and magnetite fine particles having a number-average particle diameter in the range of 0.1 to 3 μm.

In adding the first inorganic fine particles to the toner particles, if the amount of the first inorganic fine particles added is small the amorphous silicon type photoreceptor cannot be sufficiently ground, whereby a filler such as talc or calcium carbonate, or a toner component cannot be sufficiently prevented from being film-formed on the surface of the amorphous silicon type photoreceptor. On the other hand, if the amount of the first inorganic fine particles added is too large, the chargeability of the toner particles is decreased In the case of the aggregate of silica fine particles obtained by aggregating the silica fine particles which are obtained by the gas phase method, therefore, the amount of the aggregate of silica fine particles added to the toner particles is set to 0.1 to 1% by weight, and preferably 0.2 to 0.8% by weight. In the case of the silica fine particles which are obtained by the wet method, the metal zirconate fine particles, the titanium dioxide fine particles, the ferrite fine particles, and the magnetite fine particles, the amount of the fine particles added to the toner particles is set to 0.1 to 5% by weight, and preferably 0.5 to 3% by weight.

In order to prevent the chargeability of the toner particles from being degraded by adding the first inorganic fine particles, the surfaces of the first inorganic fine particles may be treated by at least one surface treating agent selected from an amino silane coupling agent and amino silicone oil.

Examples of such an amino type surface treating agent include γ-aminopropyl triethoxy silane, N-(β-aminoethyl)-γ-aminopropyl trimethoxy silane, γ-(2-aminoethyl)-γ-aminopropyl methyl dimethoxy silane, and γ-anilino propyl trimethoxy silane.

In order to improve the fluidity and the environmental stability of the developer, the first inorganic fine particles may be further subjected to surface treatment by a hydrophobic agent.

Second inorganic fine particles having an average primary particle diameter in the range of 0.005 to 0.02 μm which is subjected to hydrophobic treatment are used in addition to the above-mentioned first inorganic fine particles in order to improve the fluidity of the developer by the second inorganic fine particles as well as to enhance the environmental stability and the chargeability of the developer. The reason why second inorganic fine particles having an average primary particle diameter of 0.02 μm or less is used as the second inorganic fine particles is that if second inorganic fine particles having an average primary particle diameter of 0.02 μm or more is used, the second inorganic fine particles do not satisfactorily adhere to the surfaces of the toner particles, so that sufficient fluidity cannot be provided to the toner particles. Second inorganic fine particles having an average primary particle diameter in the range of 0.007 to 0.17 μm are preferably used.

In adding the second inorganic fine particles to the developer, if the amount of the second inorganic fine particles added is small, the fluidity or the like of the developer cannot be sufficiently improved. On the other hand, if the amount of the second inorganic fine particles added is too large, the chargeability of the toner particles is degraded, whereby the toner particles are scattered, and a formed image is fogged. Therefore, the amount of the second inorganic fine particles added to the toner particles is set to 0.05 to 1.0% by weight, and preferably 0.1 to 0.5% by weight.

As the hydrophobic agent for subjecting the second inorganic fine particles to surface treatment, the above-mentioned hydrophobic agent can be used. It is desirable to use inorganic fine particles so subjected to surface treatment that the hydrophobic degree is not less than 30%, and preferably 30 to 90%. By using the second inorganic fine particles thus made hydrophobic, the charging amount of the toner particles can be prevented from being decreased even at the time of high temperature and high humidity. Further, the second inorganic fine particles may be subjected to surface treatment by the above-mentioned amino type surface treating agent as required, so that positive chargeability can be improved.

Examples of the hydrophobic agent for subjecting the inorganic fine particles to surface treatment include a silane coupling agent, a titanate coupling agent, silicone oil, and silicone vanish. Examples of the silane coupling agent include hexamethyldisiloxane, trimethylsilane, trimethylchlorosilane, dimethyldichlorosilane, methyltrichlorosilane, aryl dimethylchlorosilane, benzyl dimethylchlorosilane methyltrimethoxysilane methyltriethoxysilane isobutyl trimethoxysilane, dimethyldimethoxy silane dimethyldiethoxysilane, trimethylmethoxysilane hidoxypropyl trimethoxysilane phenyl trimethoxysilane n-butyl trimethoxysilane, n-hexadecyl trimethoxysilane, n-octadecyl trimethoxysilane, vinyl trimethoxysilane, vinyl triethoxysilane, γ-methacryloxypropyl trimethoxysilane, and vinyl triacetoxysilane. Examples of the silicone oil include dimethyl polysiloxane, methyl hydrogen polysiloxane, and methyl phenyl polysiloxane.

In subjecting the inorganic fine particles to surface treatment by the above-mentioned hydrophobic agent, the inorganic fine particles can be subjected to surface treatment using a dry method for diluting a hydrophobic agent with a solvent, adding a dilute solution to inorganic fine particles and mixing them, heating and drying a mixture obtained, and then pulverizing the mixture, a wet method for adding and mixing a hydrophobic agent to inorganic fine particles after dispersing the inorganic fine particles in a water system and bringing the inorganic fine particles into a slurry, heating and drying a mixture obtained, and then pulverizing the mixture, and the like.

In the developer in the present invention, the developer can be used by mixing carrier particles in addition to the toner particles and the first and second inorganic fine particles. As such carrier particles, known carrier particles which have been conventionally used can be used.

If the particle diameter of the carrier particles used in the developer is small, the carrier particles easily adhere to the photoreceptor. On the other hand, if the particle diameter thereof is too large, the reproducibility of a highly precise image is degraded. Therefore, carrier particles having a volume-average particle diameter in the range of 15 to 80 μm, and preferably in the range of 20 to 70 μm are used.

If the dynamic current value of the carrier particles is small, the electrical resistance of the carrier particles is too high, whereby the toner particles cannot be sufficiently supplied to the photoreceptor, so that the development efficiency is significantly degraded. On the other hand, if the dynamic current value is large, the electrical resistance of the carrier particles is too low, whereby voids or the like are created in a formed image. Therefore, carrier particles having a dynamic current value of 5 to 120 nA, and preferably 10 to 110 nA are used.

In a first developing method according to the present invention, when the developer is conveyed to a developing region opposite to the positively charged amorphous silicon type photoreceptor by a non-magnetic sleeve having a magnet member provided in its inner periphery and driven to rotate, to carry out reversal development of an electrostatic latent image formed on the amorphous silicon type photoreceptor upon exerting a DC electric field in the developing region, binder-type carrier particles having a volume-average particle diameter in the range of 40 to 80 μm and having a dynamic current value in the range of 40 to 120 nA as described above, and preferably binder-type carrier particles having a volume-average particle diameter in the range of 45 to 75 μm and having a dynamic current value in the range of 45 to 110 nA are used in order to sufficiently prevent the carrier particles from adhering to the photoreceptor as well as to sufficiently supply the toner particles to the photoreceptor.

In the above-mentioned carrier particles, if the content of magnetic powder in the binder resin is too small, the carrier particles easily adhere. On the other hand, if the content thereof is too large, the bristles of a magnetic brush are too hard, so that an image is easily damaged by scrapping Therefore, the amount of the magnetic powder is suitably 400 to 900 parts by weight, and preferably 450 to 850 parts by weight per 100 parts by weight of the binder resin.

In the above-mentioned developing method, if the amount of the developer supplied to the developing region is too small, the background of an image is easily fogged, and the density of the image is easily reduced. On the other hand, if the amount thereof is too large, the friction of the magnetic brush is excessive, so that the quality of the image is deteriorated, and a developing portion is easily clogged with the developer. Therefore, the amount of the developer supplied to the developing region is suitably 30 to 70 mg/cm$^2$, and preferably 40 to 60 mg/cm$^2$.

In a second developing method according to the present invention, when the developer is conveyed to a developing region opposite to the positively charged amorphous silicon type photoreceptor by a non-magnetic sleeve having a magnet member provided in its inner periphery and driven to rotate, to carry out reversal development of an electrostatic latent image formed on the amorphous silicon type photoreceptor upon exerting a vibrating electric field in the developing region, even carrier particles having a small particle diameter are prevented from adhering to the photoreceptor, and the toner particles are sufficiently supplied to the photoreceptor even using carrier particles having a small dynamic current value. Therefore, binder-type carrier particles having a volume-average particle diameter in the range of 15 to 40 $\mu$m and having a dynamic current value in the range of 5 to 40 nA, and more preferably binder-type carrier particles having a volume-average particle diameter in the range of 20 to 35 $\mu$m and having a dynamic current value in the range of 10 to 35 nA are used.

In the above-mentioned carrier particles, if the content of magnetic powder in the binder resin is too small, the carrier particles easily adhere. On the other hand, if the content thereof is too large, an image becomes coarse. Therefore, the amount of the magnetic powder is suitably 100 to 400 parts by weight, and preferably 150 to 350 parts by weight per 100 parts by weight of the binder resin.

Furthermore, in the above-mentioned developing system, if the amount of the developer supplied to the developing region is too small, the toner particles are easily scattered, and the density of the image is easily made non-uniform. On the other hand, if the amount of the developer is too large, the carrier particles easily adhere, and the toner consumption efficiency is easily reduced. Therefore, the amount of the developer supplied to the developing region is suitably 0.5 to 10 mg/cm$^2$, and preferably 1 to 7 mg/cm$^2$.

A developer and a developing method according to the present invention will be specifically described by taking embodiments as examples.

In the embodiments, three types of carrier particles C1 to C3 produced in the following manner were used.

(Carrier particles C1)

In the carrier particles C1, polyester resin used as its binder resin was produced in the following manner.

In producing the polyester resin, 350 g of polyoxypropylene(2,2)-2,2-bis(4-hydroxyphenyl)propane, 330 g of polyoxyethylene(2,2)-2,2-bis(4-hydroxyphenyl) propane, 400 g of isophthalic acid, 80 g of 1,2,4-benzene tricarboxylic acid, and 2 g of dibutyltin oxide were put in a 3 liter four neck flask made of glass, and were reacted with each other while being agitated at a temperature of 200° C. under nitrogen air flow in a mantle heater after a thermometer, a stirring rod made of stainless steel, a flow type capacitor, a nitrogen inlet tube were mounted on the flask, to obtain polyester resin. The acid value of the polyester resin was 30 KOHmg/g, and the glass transition temperature Tg thereof was 65° C. The acid value was measured by a JIS K5400 method.

100 parts by weight of the polyester resin, 550 parts by weight of magnetic powder (RB-BL; made by Titan Kogyo K.K.), 5 parts by weight of carbon black having a BET specific surface area of 980 m$^2$/g and having a PH of 9.5 (Kechen Black EC; made by Lion Yushi K.K.), and 3 parts by weight of hydrophobic silica having a BET specific surface area of 250 m$^2$/g (R976; made by Nippon Aerozil K.K.) were sufficiently mixed by a Henschel mixer, were then melted and kneaded at a temperature of 180° C. by a bent biaxial kneader, were then roughly purvelized by a feather mill, were further finely purvelized by a jet pulverizer (IDS-2 Type), were air-classified, and were further heated at a temperature of 300° C. by Surfusing System (SFS-1 Type; manufactured by a Nippon Pneumatic Kogyo K.K.), to obtain carrier particles C1 having a volume-average particle diameter of 65 $\mu$m. With respect to the volume-average particle diameter of the carrier particles, a relative molecular weight distribution by particle diameter was measured by an aperture tube having a diameter of 280 $\mu$m using Coltar Multisizer (manufactured by Cortar K.K.).

(Carrier particles C2)

In the carrier particles C2, styrene type copolymer resin used for its binder resin was produced in the following manner.

In producing the styrene type copolymer resin, 120 g of styrene, 75 g of butyl methacrylate, and 5 g of methacrylic acid were put in a flask containing air replaced by nitrogen, and were then polymerized for ten hours after the internal temperature of the flask was increased to 130°, 100 g of xylene was then added thereto, and a solution obtained by melting 0.5 g of azobisisobutyronitrile in 100 g of xylene was continuously added thereto for ten hours while being kept at a temperature of 140° C., followed by polymerization for two hours, to obtain the styrene type copolymer resin. The acid value of the styrene type copolymer resin was 3 KOHmg/g, and the glass transition temperature Tg thereof was 60° C.

Carrier particles C2 having a volume-average particle diameter of 45 $\mu$m were obtained in the same manner as the carrier particles C1 except that 100 parts by weight of the styrene type copolymer resin, 450 parts by weight of magnetic powder (EPT-1000; made by Toda Kogyo K.K.), 5 parts by weight of carbon black having a BET specific surface area of 950 m$^2$/g and having a PH of 9.5 (Kechen Black EC; made by Lion Yushi K.K.), and 2 parts by weight of hydrophobic silica having a BET specific surface area of 170 m$^2$/g (H2000; manufactured by Wacker K.K.) were used.

(Carrier particles C3)

Carrier particles C3 having a volume-average particle diameter of 25 $\mu$m were obtained in the same manner as the carrier particles C1 except that 100 parts by weight of the polyester resin used in the carrier particles C1 200 parts by weight of magnetic powder (MFP-2; made by TDK Corporation) 5 parts by weight of carbon black having a BET specific surface area of 980 m$^2$/g and having a PH of 9.5 (Kechen Black EC; made by Lion Yushi K.K.), and 3 parts by weight of hydrophobic silica having a BET specific surface area of 250 m$^2$/g (R976; made by Nippon Aerozil K.K.) were used.

The dynamic current values of the carrier particles C1 to C3 obtained in the above-mentioned manner were found. The results were shown in the following Table 1.

Figure 5:
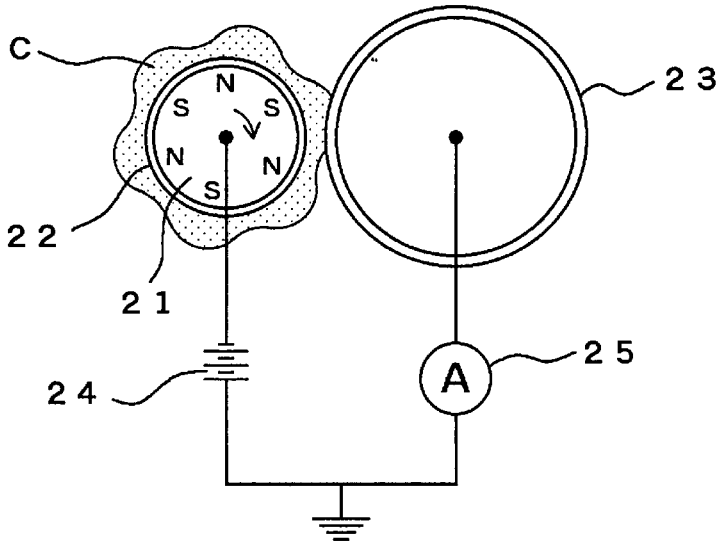
FIG. 5 is a schematic explanatory view showing a state where the dynamic current value of carrier particles is measured.

In finding the dynamic current values of the carrier particles C1 to C3, 5g of the carrier particles C were supplied to a sleeve roller 22 having a magnet roller 21 provided in its inner part and having a magnetic flux density of 1000 Gauss, the spacing between the sleeve roller 22 and an electrode tube 23 was set to 1 μm, the magnet roller 21 was rotated at a speed of rotation of 50 rpm, and a bias voltage of 500 V was applied from a power supply 24. The value of current flowing in the electrode tube 23 through the carrier particles C was measured by an ammeter 25, as shown in FIG. 5. The current value was shown as the dynamic current value in Table 1.

TABLE 1

| | carrier C1 | carrier C2 | carrier C3 |
|---|---|---|---|
| Dynamic current value(nA) | 70 | 45 | 20 |

Furthermore, eight types of toner particles t1 to t8 produced in the following manner were used as the positively charged toner particles.

(Toner particles t1)

In producing the toner particles t1, thermoplastic styrene-acrylic copolymer resin composed of 50 parts by weight of low molecular weight (L) styrene-butyl acrylatebutyl methacrylate-methacrylic acid copolymer (a monomer weight ratio=7:1.4:1.4:0.2) having a molecular weight whose distribution measured by a gel permeation chromatography (807-IT Type; manufactured by Nippon Bunko Kogyo K.K.) peaks at 5000 (a peak value 1) and 50 parts by weight of high molecular weight (H) styrene-butyl acrylate-butyl methacrylate-methacrylic acid copolymer (a monomer weight ratio=6:1.9:1.9:0.2) having a molecular weight whose distribution peaks at 219000 (a peak value 2) was used as its binder resin, as shown in the following Table 2.

4 parts by weight of polypropylene wax (Biscole 660P; made by Sanyo Kasei K.K.) having a softening point of approximately 145° C. which is an offset preventing agent, 10 parts by weight of carbon black (Mogal L; made by Cabot K.K.), 5.0 parts by weight of a nigrosine dye (Nigrosine Base EX; made by Orient Kagaku K.K.), and 0.5 parts by weight of a quaternary ammonium salt (P-53; made by Olient Kagaku K.K.) were added to 100 parts by weight of the styrene-acrylic copolymer resin. The raw materials were put in a Henschel mixer having a volume of 9 liters, and were mixed at a speed of rotation of 3000 rpm for three minutes.

A mixture obtained was continuously extruded and kneaded by a kneader (PCM30; manufactured by Ikegaiki-han K.K.), the kneaded mixture was cooled, and was then roughly purvelized by a feather mill (a 2-mm mesh), coarse powder obtained by the pulverization was finely purvelized to 11 μm by a mechanical pulverizer (Criptron KTM-O Type; manufactured by Kawasaki Heavy Industries, Ltd), the remaining coarse powder was cut by a natural air current type classifier (Jet Mill Pulverizer IDS-2 Type; manufactured by Nippon Pneumatic K.K.), and fine powder obtained by the fine pulverization was further cut by a mechanical classifier (Teeplex Ultrafine Classifier 50 ATP; manufactured by Hosokawa Mikuron K.K.), to obtain toner particles t1 having a volume-average particle diameter of 11.0 μm. With respect to the volume-average particle diameter of the toner particles, a relative molecular weight distribution by particle diameter was measured by an aperture tube having a diameter of 100 μm using Coltar Multisizer (manufactured by Cooltar K.K.).

(Toner particles t2)

In producing the toner particles t2, toner particles t2 having a volume-average particle diameter of 11.1 μm were produced in the same manner as the toner particles t1 except that only the amount of the offset preventing agent (Biscole 660P; made by Sanyo Kasei K.K.) used for producing the toner particles t1 was changed to 6 parts by weight, as shown in Table 2.

(Toner particles t3)

In producing the toner particles t3, toner particles t3 having a volume-average particle diameter of 10.9 μm were produced in the same manner as the toner particles t1 except that only the amount of the offset preventing agent (Biscole 660P; made by Sanyo Kasei K.K.) used for producing the toner particles t1 was changed to 3 parts by weight, as shown in Table 2.

(Toner particles t4)

In producing the toner particles t4, thermoplastic styrene-acrylic copolymer resin composed of 60 parts by weight of low molecular weight (L) styrene-butyl acrylate-butyl methacrylate-methacrylic acid copolymer (a monomer weight ratio=7.2:1.3:1.3:0.2) having a molecular weight whose distribution peaks at 6700 (a peak value 1) and 40 parts by weight of high molecular weight (H) styrene-butyl acrylate- butyl methacrylate-methacrylic acid copolymer (a monomer weight ratio=6.2:1.8:1.8:0.2) having a molecular weight whose distribution peaks at 412000 (a peak value 2) was used as its binder resin, as shown in Table 2.

Toner particles t4 having a volume-average particle diameter of 11.1 μm were produced in the same manner as the toner particles t1 after 6 parts by weight of the above-mentioned offset preventing agent (Biscole 660P; made by Sanyo Kasei K.K.) was added to 100 parts by weight of the styrene-acrylic copolymer resins and the other raw materials such as carbon black were added in the same ratios as those in the case of the toner particles t1.

(Toner particles 5)

In fabricating the toner particles t5, thermoplastic styrene-acrylic copolymer resin composed of 40 parts by weight of low molecular weight (L) styrene-butyl acrylate-butyl methacrylate-methacrylic acid copolymer (a monomer weight ratio=6.6:1.6:1.6:0.2) having a molecular weight whose distribution peaks at 3200 (a peak value 1) and 60 parts by weight of high molecular weight (H) styrene-butyl acrylate-butyl methacrylate-methacrylic acid copolymer (a monomer weight ratio=5.8:2.0:2.0:0.2) having a molecular weight whose distribution peaks at 121000 (a peak value 2) was used as its binder resin, as shown in Table 2.

Toner particles t5 having a volume-average particle diameter of 10.9 μm was then produced in the same manner as the toner particles t1 after 3 parts by weight of polypropylene wax having a softening point of approximately 152° C. (Biscole 330P; made by Sanyo Kasei K.K.) was added as an offset preventing agent to 100 parts by weight of the styrene-acrylic copolymer resin, and the other raw materials such as carbon black were added in the same ratios as those in the case of the toner particles t1.

(Toner particles t6)

In producing the toner particles t6, toner particles t6 having a volume-average particle diameter of 11.0 μm were produced in the same manner as the toner particles t1 except that the offset preventing agent used for producing the toner particles t1 was changed, and 4 parts by weight of polypropylene wax having a softening point of approximately 150° C. (Biscole 550P; made by Sanyo Kasei K.K.) was added.

(Toner particles t7)

In producing the toner particles t7, toner particles t7 having a volume-average particle diameter of 11.3 μm were produced in the same manner as the toner particles t1 except that 7 parts by weight of the offset preventing agent used for producing the toner particles t6 (Biscole 550P; made by Sanyo Kasei K.K.) was added, as shown in Table 2.

(Toner particles t8)

In producing the toner particles 8, toner particles t8 having a volume-average particle diameter of 10.7 μm were produced in the same manner as the toner particles t1 except that styrene-acrylic copolymer resin used for producing the toner particles t5 was used as its binder resin, and 2 parts by weight of the offset preventing agent (Biscole 550P; made by Sanyo Kasei K.K.) used for producing the toner particles t6 was used as its offset preventing agent, as shown in Table 2.

TABLE 2

| | binder resin | | | | | | offset preventing agent | |
|---|---|---|---|---|---|---|---|---|
| toner | Mn | Mw/Mn | peak value 1 | peak value 2 | H/L | softening point (° C.) | softening point (° C.) | amount of addition (parts by weight) |
| t1 | 4000 | 68.8 | 5000 | 219000 | 50/50 | 121.8 | 145 | 4 |
| t2 | 4000 | 68.8 | 5000 | 219000 | 50/50 | 121.8 | 145 | 6 |
| t3 | 4000 | 68.8 | 5000 | 219000 | 50/50 | 121.8 | 145 | 3 |
| t4 | 4500 | 83.4 | 6700 | 412000 | 60/40 | 127.5 | 145 | 6 |
| t5 | 2500 | 37.0 | 3200 | 121000 | 40/60 | 117.3 | 152 | 3 |
| t6 | 4000 | 68.8 | 5000 | 219000 | 50/50 | 121.8 | 150 | 4 |
| t7 | 4500 | 83.4 | 6700 | 412000 | 60/40 | 127.5 | 150 | 7 |
| t8 | 2500 | 37.0 | 3200 | 121000 | 40/60 | 117.3 | 150 | 2 |

An average value S of projected areas in the toner particles t1 to t8 produced in the above-mentioned manner and an average value L of the maximum lengths in projected images were measured, to find the shape factors of the toner particles t1 to t8 by the foregoing equation (1). The results, together with the volume-average particle diameters and the number-average particle diameters of the toner particles t1 to t8, were shown in the following Table 3.

TABLE 3

| toner | t1 | t2 | t3 | t4 | t5 | t6 | t7 | t8 |
|---|---|---|---|---|---|---|---|---|
| shape factor | 140 | 139 | 142 | 135 | 153 | 141 | 134 | 155 |
| volume-average particle diameter(μm) | 11.0 | 11.1 | 10.9 | 11.1 | 10.9 | 11.0 | 11.3 | 10.7 |
| number-average particle diameter(μm) | 8.5 | 8.6 | 8.4 | 8.7 | 8.3 | 8.4 | 9.0 | 8.1 |

As the above-mentioned first inorganic fine particles, 13 types of first inorganic fine particles A1 to A13 produced in the following manner were used.

(First Inorganic Fine Particles A1)

In producing the first inorganic fine particles A1, n-hexyl methoxy silane was added and mixed, while mixing and agitating rutile titania having a number-average particle diameter of 1.0 μm in a water system, in such a manner that it is 15% by weight of the titania upon being converted into a solid content, and a mixture obtained was dried and pulverized, to obtain first inorganic fine particles A1 having a hydrophobic degree of 60%.

With respect to the hydrophobic degrees 0.2 g of a sample was collected in a 100 ml beaker on the basis of a wetability measuring method using a Degussa methods 50 ml of pure water was added thereto, and methanol was added in a liquid surface while agitating the pure water. A point at which the sample was not recognized on the liquid surface was taken as a final point, to calculate the hydrophobic degree by the following equation from a required amount of methanol X.

Hydrophobic degree=$\{X/(50+X)\}\times 100$ (First Inorganic Fine Particles A2)

In producing the first inorganic fine particles A2, n-octyl methoxy silane and γ-aminopropyl triethoxy silane were added and mixed, while mixing and agitating silica having an average primary particle diameter of 0.04 μm obtained by a gas phase method in a water system, in such a manner that they are respectively 20% by weight and 5% by weight upon being converted into solid contents, and a mixture obtained was dried and pulverized, to obtain first inorganic fine particles A2 having a hydrophobic degree of 75% and having a number-average particle diameter of 0.2 μm.

(First inorganic fine particles A3)

Ferrite having a number-average particle diameter of 0.5 μm was used as the first inorganic fine particles A3.

(First Inorganic Fine Particles A4)

Magnetite having a number-average particle diameter of 1.5 μm was used as the first inorganic fine particles A4.

(First Inorganic Fine Particles A5)

Strontium zirconate having a number-average particle diameter of 3 μm was used as the first inorganic fine particles A5.

(First Inorganic Fine Particles A6)

In producing the first inorganic fine particles A6, first inorganic fine particles A6 having a hydrophobic degree of 30% was obtained in the same manner as the first inorganic fine particles A1 except that silica having a number-average particle diameter of 1 μm obtained by a wet method was used.

(First Inorganic Fine Particles A7)

Alumina having a number-average particle diameter of 1 μm was used as the first inorganic fine particles A7.

(First Inorganic Fine Particles A8)

In producing the first inorganic fine particles A8, n-hexyl methoxy silane and γ-aminopropyl triethoxy silane were added and mixed, while mixing and agitating rutile titania having a number-average particle diameter of 1.0 μm in a water system, in such a manner that they are respectively 15% by weight and 5% by weight of the titania upon being converted into solid contents, and a mixture obtained was dried and pulverized, to obtain first inorganic fine particles A8 having a hydrophobic degree of 65%.

(First Inorganic Fine Particles A9)

In producing the first inorganic fine particles A9, first inorganic fine particles A9 having a hydrophobic degree of 20% was obtained in the same manner as the first inorganic fine particles A1 except that ferrite having a number-average particle diameter of 0.5 μm was used, and 10% by weight of amino silicone oil was used in place of 5% by weight of γ-aminopropyl triethoxy silane.

(First Inorganic Fine Particles A10)

In producing the first inorganic fine particles A10, first inorganic fine particles A10 having a hydrophobic degree of 20% was obtained in the same manner as the first inorganic fine particles A9 except that magnetite having a number-average particle diameter of 0.5 μm was used.

(First Inorganic Fine Particles A11)

In producing the first inorganic fine particles A11, first inorganic fine particles A11 having a hydrophobic degree of 20% was obtained in the same manner as the first inorganic fine particles A9 except that strontium zirconate having a number-average particle diameter of 3 μm was used.

(First Inorganic Fine Particles A12)

In producing the first inorganic fine particles A12, first inorganic fine particles A12 having a hydrophobic degree of 40% was obtained in the same manner as the first inorganic fine particles A8 except that silica having a number-average particle diameter of 1 μm obtained by a wet method was used.

(First Inorganic Fine Particles A13)

In producing the first inorganic fine particles A13, first inorganic fine particles A13 having a hydrophobic degree of 50% was obtained in the same manner as the first inorganic fine particles A8 except that alumina having a number-average particle diameter of 1 μm was used.

Furthermore, as second inorganic fine particles subjected to hydrophobic treatments the following four types of second inorganic fine particles B1 to B4 were used.

An example of the second inorganic fine particles B1 was hydrophobic silica having an average primary particle diameter of 0.016 μm (R972 having a hydrophobic degree of 40%; made by Nippon Aerozil K.K.), an example of the second inorganic fine particles B2 was hydrophobic silica having an average primary particle diameter of 0.012 μm (R974 having a hydrophobic degree of 35%; made by Nippon Aerozil K.K.), an example of the second inorganic fine particles B3 was hydrophobic silica having an average primary particle diameter of 0.009 μm (R976 having a hydrophobic degree of 30%; made by Nippon Aerozil K.K.), and an example of the second inorganic fine particles B4 was hydrophobic silica having an average primary particle diameter of 0.012 μm which is subjected to surface treatment by a hydrophobic agent and an amino silane coupling agent (RA200HS having a hydrophobic degree of 65%; made by Nippon Aerozil K.K.).

Developers in experimental examples 1 to 19 were adjusted, as shown in Table 4, using the carrier particles C1 to C3, the toner particles t1 to t8, the first inorganic fine particles A1 to A13, and the second inorganic fine particles B1 to B4.

TABLE 4

| | | first inorganic fine particles | | second inorganic fine particles | | | |
|---|---|---|---|---|---|---|---|
| experimental example | toner | type | amount of addition (wt %) | type | amount of addition (wt %) | carrier | toner mixture ratio (wt %) |
| 1 | t1 | A3 | 1.0 | B2 | 0.2 | C1 | 5 |
| 2 | t2 | A4 | 1.0 | B3 | 0.1 | C2 | 5 |
| 3 | t3 | A5 | 3.0 | B1 | 0.4 | C3 | 10 |
| 4 | t4 | A6 | 2.0 | B3 | 0.15 | C1 | 5 |
| 5 | t5 | A7 | 2.0 | B2 | 0.15 | C1 | 5 |
| 6 | t6 | A1 | 2.0 | B2 | 0.15 | C1 | 5 |
| 7 | t6 | A2 | 0.3 | B2 | 0.2 | C1 | 5 |
| 8 | t1 | A9 | 1.0 | B2 | 0.2 | C1 | 5 |
| 9 | t2 | A10 | 1.0 | B3 | 0.1 | C2 | 5 |
| 10 | t3 | A11 | 3.0 | B1 | 0.4 | C3 | 10 |
| 11 | t4 | A12 | 2.0 | B3 | 0.15 | C1 | 5 |
| 12 | t5 | A13 | 2.0 | B2 | 0.15 | C1 | 5 |
| 13 | t6 | A8 | 2.0 | B2 | 0.15 | C1 | 5 |
| 14 | t6 | A2 | 0.3 | B2 | 0.15 | C1 | 5 |
| 15 | t1 | A9 | 1.0 | B4 | 0.15 | C1 | 5 |
| 16 | t7 | — | — | B2 | 0.15 | C1 | 5 |
| 17 | t8 | A7 | 3.0 | — | — | C1 | 5 |
| 18 | t6 | A2 | 0.3 | B2 | 0.15 | C3 | 10 |
| 19 | t6 | A2 | 0.3 | B2 | 0.15 | C1 | 5 |

With respect to the developers in the above-mentioned experimental examples 1 to 19, fluidity, environmental resistance, film-forming properties, a charging amount of toner particles, fogging, and fogging of carrier particles were evaluated. The results thereof were shown in the following Table 5.

With respect to the fluidity in each of the developers, the apparent bulk specific gravity (g/cc) of the toner particles used in the developer was measured by Powder Tester (manufactured by Hosokawa Mikuron K.K.). The fluidity was evaluated as ○ when the apparent bulk specific gravity was not less than 0.380, Δ when it was not less than 0.360 and less than 0.380, and X when it was less than 0.360. The results were shown in Table 5.

With respect to the environmental resistance in each of the developers, the changing amount after exposing the developer under a temperature of 10° C. and a relative humidity of 15% for 24 hours was measured, and the charging amount after exposing the developer under a temperature of 30° C. and a relative humidity of 85% for 24 hours was further measured. The difference between both the charging amounts was found. The environmental resistance was indicated by ○ when the difference was less than 5 μC/g so that the developer is good, Δ when the difference was in the range of 5 to 10 $\mu$C/g so that the developer cannot be practically used, and X when the difference was more than 10 $\mu$C/g so that the developer practically presents a problem. The results were shown in FIG. 5.

With respect to the charging amount of the toner particles in each of the developers, the developer was put in a 50 cc container, and was rotated at a speed of rotation of 120 rpm for ten minutes on a rotating machine, to adjust the developer.

Figure 6:
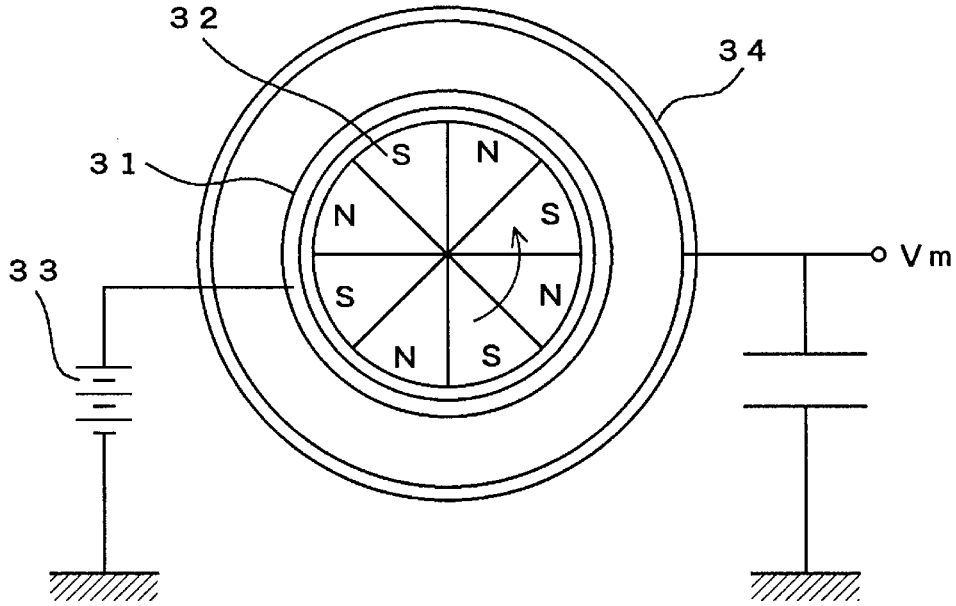
FIG. 6 is a schematic explanatory view of a device used for measuring the changing amount of toner particles.

In a developing device shown in FIG. 6, 1 g of each of the developers adjusted in the above-mentioned manner was weighed by a precision balance, the developer thus weighed was so placed as to be uniform on the entire surface of a conductive sleeve 31, the speed of rotation of a magnet roll 32 provided in the developing sleeve 31 was set to 100 rpm, a bias voltage of 3 kV which is opposite in polarity to a charging potential of the toner particles was applied from a bias power supply 33, and the magnet roll 32 was rotated for 30 seconds. A potential Vm in a cylinder electrode 34 was read at the time point where the magnet roll 32 was stopped, and the weight of the toner particles adhering to the cylinder electrode 34 from the conductive sleeve 31 was measured by a precision balance, to find the average charging amount ($\mu$C/g) of the toner particles.

In evaluating the film-forming properties, the fogging and the fogging of carrier particles in each of the developers, a commercially available copying machine (EP9765; manufactured by Minolta Camera Co, Ltd.) was converted and was used by using an amorphous silicon type photoreceptor for a photosensitive drum and changing a developing bias or the like in the developing device as described below with respect to each of the developers in the experimental examples 1, 2, 4 to 9, and 11 to 18.

Figure 7:
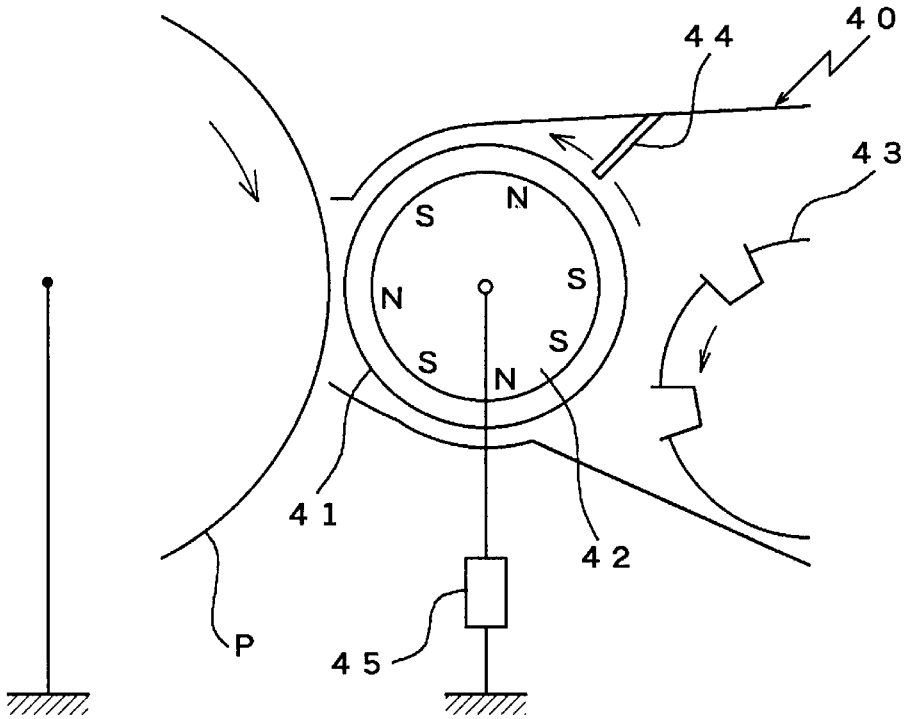
FIG. 7 is a schematic explanatory view of a developer for carrying out reversal development upon exerting a DC electric field as a developing bias.

A developing device for carrying out reversal development of an electrostatic latent image formed on an amorphous silicon type photoreceptor is so constructed that a developing sleeve 41 is provided opposite to a photosensitive drum P composed of the amorphous silicon type photoreceptor, and a magnet roller 42 having a plurality of magnetic poles N, S, . . . provided therein is fixedly arranged in the inner periphery of the developing sleeve 41, as shown in FIG. 7. A developer was contained inside an apparatus body 40, and the developer was supplied to the developing sleeve 41 upon being mixed and agitated by a bucket roller 43 provided in the apparatus body 40.

The photosensitive drum P and the developing sleeve 41 were rotated, to convey the developer toward the photosensitive drum P as the developing sleeve 41 was rotated while binding the developer on the developing sleeve 41 by a magnetic force of the magnet roller 42. The amount of the developer thus conveyed was regulated by a regulating member 44, to introduce 30 to 70 mg/cm$^2$ and preferably 40 to 60 mg/cm$^2$ of the developer into a developing region opposite to the photosensitive drum P. A DC bias voltage was applied from a DC power supply 45 to the developing sleeve 41 to exert a DC electric field on the developing region, to carry out reversal development.

In developing an electrostatic latent image formed on the photosensitive drum P composed of the amorphous silicon type photoreceptor using each of the abovementioned developers, an initial surface potential of the photosensitive drum P was set to +700 V, a surface potential in an exposed portion was set to +80 V, the amount of the developer d conveyed to the developing region by the developing sleeve 41 was set to 45 mg/cm$^2$, the distance Ds at which the photosensitive drum P and the developing sleeve 41 are opposite to each other was set to 0.7 mm, the peripheral speed of the photosensitive drum P was set to 460 mm/s, the peripheral speed of the developing sleeve 41 was set to 380 mm/s, and a DC voltage of +500 V was applied as a developing bias voltage to the developing sleeve 41 from the DC power supply 45, to carry out reversal development.

Figure 8:
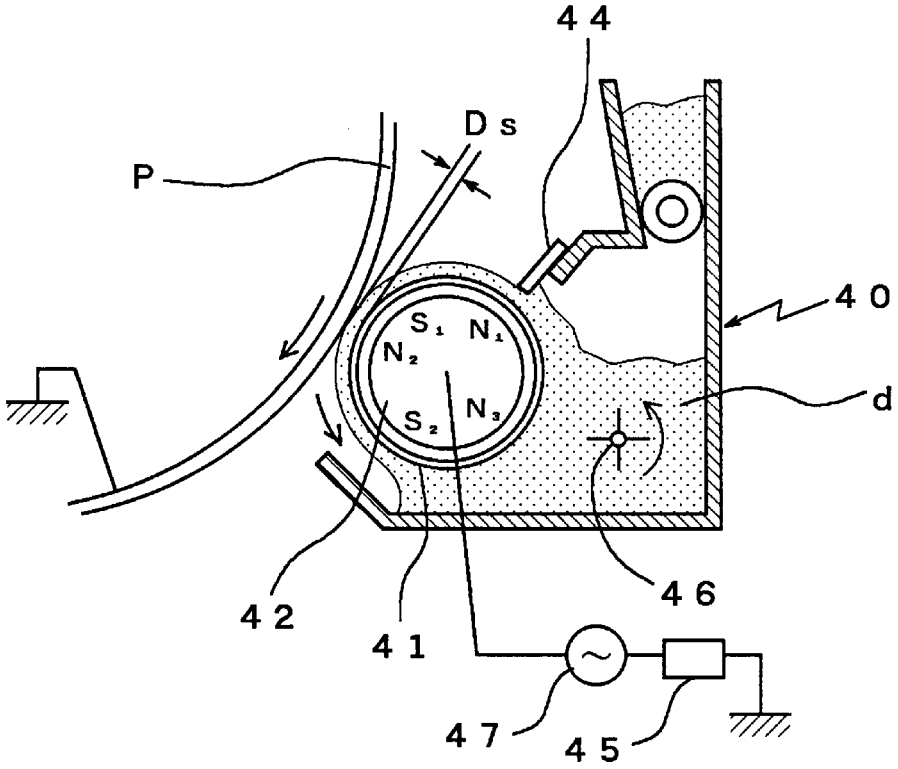
FIG. 8 is a schematic explanatory view of a developing device for carrying out reversal development upon exerting a vibrating electric field as a developing bias.

On the other hand, in evaluating the film-forming properties, the fogging and the fogging of carrier particles with respect to each of the developers in the experimental examples 3, 10 and 19, a developing device shown in FIG. 8 was used.

A developing device shown in FIG. 8 is also so constructed that a developing sleeve 41 is provided opposite to a photosensitive drum P composed of an amorphous silicon type photoreceptor through a required distance Ds, and a magnet roller 42 having a plurality of magnetic poles N, S, . . . provided therein is fixedly arranged in the inner periphery of the developing sleeve 41. A developer d was contained inside an apparatus body 40, and the developer d was mixed and agitated by a mixing and agitating member 46 provided inside the apparatus body 40 and was supplied to the developing sleeve 41.

The photosensitive drum P and the developing sleeve 41 were rotated, to convey the developer d toward the photosensitive drum d as the developing sleeve 41 was rotated while binding the developer d on the developing sleeve 41 by a magnetic force of the magnet roller 42. The amount of the developer d thus conveyed was regulated by a regulating member 44, to introduce 0.5 to 10 mg/cm$^2$ and preferably 1 to 7 mg/cm$^2$ of the developer into a developing region opposite to the photosensitive drum P. A developing bias voltage in which an AC voltage is superimposed on a DC voltage was applied from an AC power supply 47 and a DC power supply 45 which are connected to the developing sleeve 41 to exert a vibrating electric field on the developing region, to carry out reversal development.

In developing an electrostatic latent image formed on the photosensitive drum P composed of an amorphous silicon type photoreceptor using each of the above-mentioned developers, an initial surface potential of the photosensitive drum P was set to +700 V, a surface potential in an exposed portion was set to +80 V, the amount of the developer d conveyed to the developing region by the developing sleeve 41 was set to 5 mg/cm$^2$, the distance Ds at which the photosensitive drum P and the developing sleeve 41 are opposite to each other was set to 0.3 mm, the peripheral speed of the photoreceptor 2 was set to 165 mm/s, the peripheral speed of the developing sleeve 41 was set to 300 mm/s, a developing bias voltage in which an AC voltage composed of a rectangular wave having a peak-to-peak value Vp-p of 1.5 kV and having a frequency of 2.5 kHz, and having a duty ratio (development:recovery) of 1:1 is superimposed on a DC voltage of +500 V was applied to the developing sleeve 41 from the AC power supply 47 and the DC power supply 45 to exert the vibrating electric field, to carry out reversal development.

In evaluating the film-forming properties, 50,000 copies were made using a document having a black ratio of 6% with respect to each of the developers, after which a formed image was visually evaluated. The film-forming properties were indicated by ○ when no film-formation was observed, Δ when film-formation was produced on the surface of the photoreceptor, and X when noise caused by film-formation was produced on paper on which an image is formed.

Although in evaluating the fogging, 50,000 copies were made using a document having a black ratio of 6% with respect to each of the developers, after which a formed image was visually evaluated. The fogging was evaluated as ○ when fogging was hardly observed, Δ when fogging does not practically present a problem, although it was slightly recognized, and X when a lot of fogging was observed.

Also in evaluating the fogging of carrier particles, 50,000 copies were made in the same manner as described above, after which a formed image was visually evaluated. The fogging of carrier particles was evaluated as ○ when fogging of carrier particles on an image was hardly observed, Δ when fogging of carrier particles does not practically present a problem, although it was slightly recognized, and X when a lot of fogging of carrier particles was observed.

TABLE 5

| experimental example | fluidity | environmental resistance | film-forming properties | charging amount (μC/g) | fogging | fogging of carrier particles |
|---|---|---|---|---|---|---|
| 1 | ○ | Δ | ○ | 20.6 | ○ | ○ |
| 2 | Δ | Δ | ○ | 21.3 | ○ | ○ |
| 3 | ○ | Δ | ○ | 18.3 | ○ | ○ |
| 4 | ○ | ○ | Δ | 17.5 | Δ | ○ |
| 5 | ○ | Δ | ○ | 17.9 | ○ | ○ |
| 6 | ○ | ○ | ○ | 17.1 | ○ | ○ |
| 7 | ○ | ○ | ○ | 20.4 | ○ | ○ |
| 8 | ○ | ○ | ○ | 23.1 | ○ | ○ |
| 9 | Δ | ○ | ○ | 23.9 | ○ | ○ |
| 10 | ○ | ○ | ○ | 20.6 | ○ | ○ |
| 11 | ○ | Δ | Δ | 19.0 | ○ | ○ |
| 12 | ○ | ○ | ○ | 19.0 | ○ | ○ |
| 13 | ○ | ○ | ○ | 18.9 | ○ | ○ |
| 14 | ○ | ○ | ○ | 20.9 | ○ | ○ |
| 15 | ○ | ○ | ○ | 23.8 | ○ | ○ |
| 16 | ○ | ○ | x | 22.0 | ○ | ○ |
| 17 | x | x | Δ | 14.1 | x | ○ |
| 18 | ○ | ○ | ○ | 21.2 | ○ | x |
| 19 | ○ | ○ | ○ | 20.4 | ○ | x |

Although the present invention has been fully described by way of examples, it is to be noted that various changes and modification will be apparent to those skilled in the art.

Therefore, unless otherwise such changes and modifications depart from the scope of the present inventions they should be construed as being included therein.

What is claimed is:

1. A developer for carrying out reversal development of an electrostatic latent image formed on a positively charged amorphous silicon type photoreceptor, comprising:

positively charged toner particles containing binder resin and a colorant;

first inorganic fine particles having a number-average particle diameter of 0.1 to 3 μm and subjected to surface treatment by at least one type of surface treating agent selected from the group consisting of an amino silane coupling agent and amino silicone oil; and second inorganic fine particles subjected to surface treatment by a hydrophobic agent and having an average primary particle diameter of 0.005 to 0.02 μm.

2. The developer according to claim 1, wherein said first inorganic fine particles are further subjected to surface treatment by a hydrophobic agent.

3. The developer according to claim 1, wherein said second inorganic fine particles are subjected to surface treatment by at least one type of surface treating agent selected from the group consisting of an amino silane coupling agent and amino silicone oil.

4. The developer according to claim 1, wherein said first inorganic fine particles are an aggregate of silica fine particles having an average primary particle diameter of 0.03 to 0.05 μm obtained by a gas phase method, an amount of the aggregate of silica fine particles added being 0.1 to 1% by weight of the toner particles.

5. The developer according to claim 1, wherein said first inorganic fine particles are silica fine particles obtained by a wet method, an amount of the silica fine particles added being 0.1 to 5% by weight of the toner particles.

6. The developer according to claim 1, wherein said first inorganic fine particles are metal zirconate fine particles having a number-average particle diameter of 0.5 to 3 μm, an amount of the fine particles added being 0.1 to 5% by weight of the toner particles.

7. The developer according to claim 1, wherein said first inorganic fine particles are titanium dioxide fine particles having a number-average particle diameter of 0.5 to 3 μm, an amount of the fine particles added being 0.1 to 5% by weight of the toner particles.

8. The developer according to claim 1, wherein said first inorganic fine particles are ferrite fine particles or magnetite fine particles, an amount of the fine particles added being 0.1 to 5% by weight of the toner particles.

9. The developer according to claim 1, wherein a volume-average particle diameter of said toner particles is 6 to 12 μm, and a ratio of the volume-average particle diameter to a number-average particle diameter (the volume-average particle diameter/the number-average particle diameter) is 1.0 to 1.5.

10. The developer according to claim 9, wherein a shape factor of said toner particles is 130 to 160.

11. The developer according to claim 10, wherein the ratio of the volume-average particle diameter to the number-average particle diameter (the volume-average particle diameter/the number-average particle diameter) is 1.0 to 1.35, and the shape factor of the toner particles is 130 to 150.

12. The developer according to claim 1, wherein a number-average molecular weight of said binder resin is 2000 to 7000, and a ratio of a weight-average molecular weight to number-average molecular weight (the weight-average molecular weight/the number-average molecular weight) is 30 to 90.

13. The developer according to claim 1, wherein said binder resin having peaks in a molecular weight distribution by weight measured by gel permeation chromatography, wherein a first peak is in a range of 2000 to 20000 and a second peak is in a range of 50000 to 1000000.

14. The developer according to claim 1, wherein said developer contains carrier particles.

15. The developer according to claim 14, wherein said carrier particles are constructed by dispersing magnetic powder in a binder resin, a volume-average particle diameter of the carrier particles being 15 to 80 $\mu$m, and a dynamic current value thereof being 5 to 120 nA.

16. A developing method comprising the steps of:

supplying a developer including positively charged toner particles containing binder resin and a colorant, first inorganic fine particles having a number-average particle diameter of 0.1 to 3 $\mu$m, second inorganic fine particles subjected to surface treatment by a hydrophobic agent and having an average primary particle diameter of 0.005 to 0.02 $\mu$m, and carrier particles having a volume-average particle diameter of 40 to 80 $\mu$m, having a dynamic current value of 40 to 120 nA, and constructed by dispersing magnetic powder in binder resin onto a nonmagnetic sleeve having a magnet member arranged in its inner part and driven to rotate;

conveying said developer to a developing region which is a portion where the non-magnetic sleeve and a positively charged amorphous silicon type photoreceptor are opposite to each other by the rotation of the nonmagnetic sleeve; and carrying out reversal development of an electrostatic latent image formed on the amorphous silicon type photoreceptor by said toner particles upon exerting a direct current electric field in the developing region.

17. The developing method according to claim 16, wherein an amount of the developer conveyed to said developing region is 30 to 70 mg/cm$^2$ .

18. The developing method according to claim 17, wherein the amount of said developer is 40 to 60 mg/cm$^2$, and the volume-average particle diameter of said carrier particles is 45 to 75 $\mu$m, and the dynamic current value thereof is 45 to 110 nA.

19. A developing method comprising the steps of:

supplying a developer including positively charged toner particles containing binder resin and a colorant, first inorganic fine particles having a number-average particle diameter of 0.1 to 3 $\mu$m; second inorganic fine particles subjected to surface treatment by a hydrophobic agent and having an average primary particle diameter of 0.005 to 0.02 $\mu$m, and carrier particles having a volume-average particle diameter of 15 to 40 $\mu$m, having a dynamic current value of 5 to 40 nA, and constructed by dispersing magnetic powder in binder resin onto a non-magnetic sleeve having a magnet member arranged in its inner part and driven to rotate;

conveying said developer to a developing region which is a portion where the non-magnetic sleeve and a positively charged amorphous silicon type photoreceptor are opposite to each other by the rotation of the non-magnetic sleeve; and carrying out reversal development of an electrostatic latent image formed on the amorphous silicon type photoreceptor by said toner particles upon exerting a vibrating electric field in the developing region.

20. The developing method according to claim 19, wherein an amount of said developer conveyed to said developing region is 0.5 to 10 mg/cm$^2$.

21. The developing method according to claim 19, wherein the amount of said developer is 1 to 7 mg/cm$^2$, and the volume-average particle diameter of said carrier particles is 20 to 40 $\mu$m, and the dynamic current value thereof is 10 to 35 nA.

22. A developer for carrying out reversal development of an electrostatic latent image formed on a positively charged amorphous silicon type photoreceptor comprising:

positively charged toner particles containing binder resin and a colorant;

first inorganic fine particles having a number-average particle diameter of 0.11 to 3 $\mu$m; and second inorganic fine particles subjected to surface treatment by a hydrophobic agent and at least one type of surface treating agent selected from the group consisting of an amino silane coupling agent and amino silicone oil, said second inorganic fine particles having an average primary particle diameter of 0.005 to 0.02 $\mu$m.

23. The developer according to claim 22, wherein said first inorganic fine particles are an aggregate of silica fine particles having an average primary particle diameter of 0.03 to 0.05 $\mu$m obtained by a gas phase method, an amount of the aggregate of silica fine particles added being 0.1 to 1% by weight of the toner particles.

24. The developer according to claim 22, wherein said first inorganic fine particles are silica fine particles obtained by a wet method, an amount of the silica fine particles added being 0.1 to 5% by weight of the tone particles.

25. The developer according to claim 22, wherein said first inorganic fine particles are metal zirconate fine particles having a number-average particle diameter of 0.5 to 3 $\mu$m, an amount of the fine particles added being 0.1 to 5% by weight of the toner particles.

26. The developer according to claim 22, wherein said first inorganic fine particles are titanium dioxide fine particles having a number-average particle diameter of 0.5 to 3 $\mu$m, an amount of the fine particles added being 0.1 to 5% by weight of the toner particles.

27. The developer according to claim 22, wherein said first inorganic fine particles are ferrite fine particles or magnetite fine particles, an amount of the fine particles added being 0.1 to 5% by weight of the toner particles.

28. The developer according to claim 22, wherein a volume-average particle diameter of said toner particles is 6 to 12 $\mu$m, and a ratio of a volume-average particle diameter to a number-average particle diameter (the volume-average particle diameter/the number-average particle diameter) is 1.0 to 1.5.

29. The developer according to claim 28, wherein the ratio of the volume-average particle diameter to a number-average particle diameter is 1.0 to 1.35.

30. The developer according to clam 28, wherein a shape factor of said toner particles is 130 to 160.

31. The developer according to claim 22, wherein a number-average molecular weight of said binder resin is 2000 to 7000, and a ratio of a weight-average molecular weight to a number-average molecular weight (the weight-average molecular weight/the number-average molecular weight) is 30 to 90.

32. The developer according to claim 22, wherein said binder resin having peaks in a molecular weight distribution by weight measured by gel permeation chromatography, wherein a first peak is in a range of 2000 to 20000 and a second peak is in a range of 50000 to 1000000.

* * * * *

UNITED STATES PATENT AND TRADEMARK OFFICE

CERTIFICATE OF CORRECTION

PATENT NO. : 5,914,210

DATED : June 22, 1999

INVENTOR(S) : Demizu et al.

It is certified that error appears in the above-indentified patent and that said Letters Patent is hereby corrected as shown below:

In the claims:

Claim 22, line 42, change "0.11" to --0.1--; and

Claim 30, line 4, change "clam" to --claim--.

Signed and Sealed this

Twenty-third Day of November, 1999

*Attest:*

Q. TODD DICKINSON

*Attesting Officer*

*Acting Commissioner of Patents and Trademarks*